US007802612B2

(12) United States Patent
Yoshii et al.

(10) Patent No.: US 7,802,612 B2
(45) Date of Patent: Sep. 28, 2010

(54) DIE CASTING MOLD AND METHOD OF MANUFACTURING AND CASTING THE SAME

(75) Inventors: Hiroshi Yoshii, Shizuoka (JP); Kimitoshi Satou, Shizuoka (JP); Takayoshi Inamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 444 days.

(21) Appl. No.: 12/063,457

(22) PCT Filed: Jul. 31, 2006

(86) PCT No.: PCT/JP2006/315115

§ 371 (c)(1),
(2), (4) Date: Feb. 11, 2008

(87) PCT Pub. No.: WO2007/018063

PCT Pub. Date: Feb. 15, 2007

(65) Prior Publication Data

US 2009/0260773 A1 Oct. 22, 2009

(30) Foreign Application Priority Data

Aug. 11, 2005 (JP) ..... 2005-233770

(51) Int. Cl.
*B22D 17/10* (2006.01)
*B22D 17/22* (2006.01)

(52) U.S. Cl. ..... 164/113; 164/312

(58) Field of Classification Search ..... 164/113, 164/119, 120, 306–320
See application file for complete search history.

(56) References Cited

FOREIGN PATENT DOCUMENTS

| | | | |
|---|---|---|---|
| JP | 5-84457 | U | 11/1993 |
| JP | 7-73783 | B2 | 8/1995 |
| JP | 2002-079357 | A | 3/2002 |

OTHER PUBLICATIONS

Official communication issued in the International Application No. PCT/JP2006/315115, mailed on Oct. 31, 2006.
Official communication issued in counterpart European Application No. 06781993.8, mailed on July 4, 2008.

*Primary Examiner*—Kuang Lin
(74) *Attorney, Agent, or Firm*—Keating & Bennett, LLP

(57) ABSTRACT

In a die-casting mold used in a casting method, a fixed insert includes a recessed cavity portion, and a fixed mold body is arranged to hold the fixed insert. The fixed insert includes a first insert and a second insert. The first insert is held with the fixed mold body. The second insert is fitted and held within a recess formed on the first insert. The size of the second insert is minimized so as to just surround the recessed cavity portion.

13 Claims, 5 Drawing Sheets

DIE CASTING MOLD AND METHOD OF MANUFACTURING AND CASTING THE SAME

BACKGROUND OF THE INVENTION

1. Field of the Invention

The present invention relates to a die casting mold in which a recessed cavity portion is provided on an insert, and relates to a method of manufacturing and casting the die casting mold.

2. Description of the Related Art

A conventional die casting mold of the above-described type is disclosed, for example, in JP-B-Hei 7-73783. The mold described in this publication includes a fixed mold attached to a fixed platen of a die casting machine, and a movable mold attached to a movable platen thereof.

The fixed mold includes a fixed insert, on which a recessed portion defining a cavity is provided, and a mold body for holding the fixed insert. The movable mold includes a movable insert that has a projecting portion facing the recessed portion which forms the cavity in cooperation with the fixed insert, and a mold body for holding the movable insert.

As described above, the mold which is divided into the insert and the mold body for defining the cavity allows the optimum selection of metal materials, types of heat processing to enhance the hardness, and so forth, for the functions of the mold members. In other words, the aforementioned construction is used in order to provide an insert of a metal material having sufficient hardness and toughness to withstand the die casting environment, and allow the insert to be subjected to heat processing so that the insert has a hardness greater than that of the mold body.

This type of insert is used to repeat shots several thousand times in die casting operations, which causes a tendency for a cast product to have defects on the surface, which are called heat checks.

The heat checks refer to a lattice pattern (check pattern) on a portion of an outside surface of the cast product whose curvature is relatively large.

The cause of heat checks is that the lattice-patterned cracks are produced on the inner surface of the recessed cavity portion of the insert. Molten metal runs through and solidifies in the cracks of the mold, and protrudes from the surface of the cast product as heat checks.

Cracks, a cause of the heat checks, are produced on the surface of the mold by repeated heating and cooling due to thermal stresses. More specifically, cracks are produced due to thermal stresses that concentrate on a portion of the inner surface of the recessed cavity portion whose curvature is relatively large. Such cracks are initially shallow and short. Repeated thermal expansion/contraction of the mold results in the fine cracks gradually becoming larger (deeper and longer) to permit molten metal to easily run into the cracks.

In the event that the heat checks are produced on the exterior part of the cast product, in the conventional manner, a grinding tool, such as sandpaper and a buffer, has been used to remove the heat checks.

In addition, in the event that it takes a longer time to repair the cast products, or the repair work is more difficult, due to larger heat checks or the increased number of locations where heat checks occur, the insert is repaired to eliminate the cracks or is replaced with a new one by a method to be discussed below.

The insert is repaired by either one of the two types of methods below. The first method includes removing a portion of the insert where cracks, a cause of heat checks, are produced; build-up welding on this portion; and reprocessing thereof, thereby restoring the mold shape. The second method includes interposing a spacer between the inner bottom of the recess of the mold body and the insert fitted into the recess.

Interposing the spacer between the insert and the mold body in such a manner causes the entire insert to protrude from the mold body by an amount consistent with the thickness of the spacer. The second method also includes removing a mating surface of the insert to the other mold and a surface of the recessed cavity portion by means of electrical discharge machining or the like by an amount of the protrusion of the insert from the mold body. Thereby, the mold is restored to the original shape.

Among conventional inserts for die casting molds, an insert to be used for casting large parts, such as a vehicle frame for a motorcycle, has large dimensions including a thickness sufficient to be almost equal to its height or width. Even if such a large-dimensioned insert is made of the optimum material and subjected to heat processing for enhanced hardness, there are still problems with heat checks that can occur in a relatively short time after the heat processing.

The potential cause of this is that the insert is not always subjected to heat processing entirely equally due to its relatively large size and volume, and accordingly, the cavity is not equally subjected to the heat processing.

In addition, a worker has to manually repair a cast product having heat checks or remove the heat checks. Moreover, the worker must be careful during this repair work because it involves machining of the exterior portion of the product. This creates a problem of a significant increase in man-hours for removing the heat checks.

Further, even if the cracks on the inside of the recessed cavity portion, which can cause heat checks, are removed, there still arises a problem that the heat checks can re-occur in a relatively short time after the repair. The reason for this is that the insert is repaired by removal of the cracks on the inside of the recessed cavity portion, and then build-up welding the cracked portion, which results in lower hardness and toughness on the build-up welded area compared to the other areas. In contrast, the method, using the spacer to allow the large-dimensioned insert to protrude from the mold body and remove the protruding portion, fails to completely remove deep cracks largely due to the long time that elapses before the repair. This prevents the insert from being restored to its initial conditions.

Therefore, the remaining minor cracks on the insert spread, causing heat checks in a short time after their removal. As described above, the method of removing the protruding portion of the insert from the mold body must involve cutting a peripheral portion of the insert around the cavity. A sprue or other portions tend to be provided around the peripheral portion.

In other words, the removal work must involve cutting not only the protruding portion of the insert, but also the peripheral portion thereof. This creates a problem of a longer time required for the cutting work.

In addition, in the case of replacing the insert with a new one, rather than refurbishing the insert, other usable portions of the cavity, such as the sprue portion, are also covered by this replacing, which results in an increased cost.

SUMMARY OF THE INVENTION

In order to overcome the problems described above, preferred embodiments of the present invention provide a die casting mold which reduces the occurrence of heat checks, a method of manufacturing the die casting mold which facilitates repairing of an insert, and a casting method which prevents the occurrence of heat checks, while enhancing the endurance and the number of casting cycles compared to the conventional art.

A die casting mold according to a preferred embodiment of the present invention includes an insert on which a recessed cavity portion is provided, and a mold body arranged to hold the insert, in which the insert includes a first insert held by the mold body and a second insert fitted and held within a recess provided on the first insert, and the size of the second insert is minimized as to just surround the recessed cavity portion.

According to a preferred embodiment of the present invention, when the first insert is the same size as the conventional insert, the second insert provided with the recessed cavity portion is smaller than the conventional insert. This allows the entire second insert to be equally and sufficiently subjected to heat processing and provides a die casting mold which can reduce the occurrence of heat checks.

With the die casting mold according to a preferred embodiment of the present invention, in the event that abnormal cast products are manufactured having unrepairable cracks on the recessed cavity portion, only the second insert is replaced with a new one, so that the quality of the cast products is maintained from the beginning of the manufacturing. Thus, according to a preferred embodiment of the present invention, only the relatively smaller-sized second insert needs be replaced, so that the mold repair costs can be reduced compared to the conventional art in which a large-sized insert must be replaced. Moreover, the second insert is small and easily fabricated, and accordingly the time required for the aforementioned repairing (the time required for re-fabricating the second insert) is also reduced.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
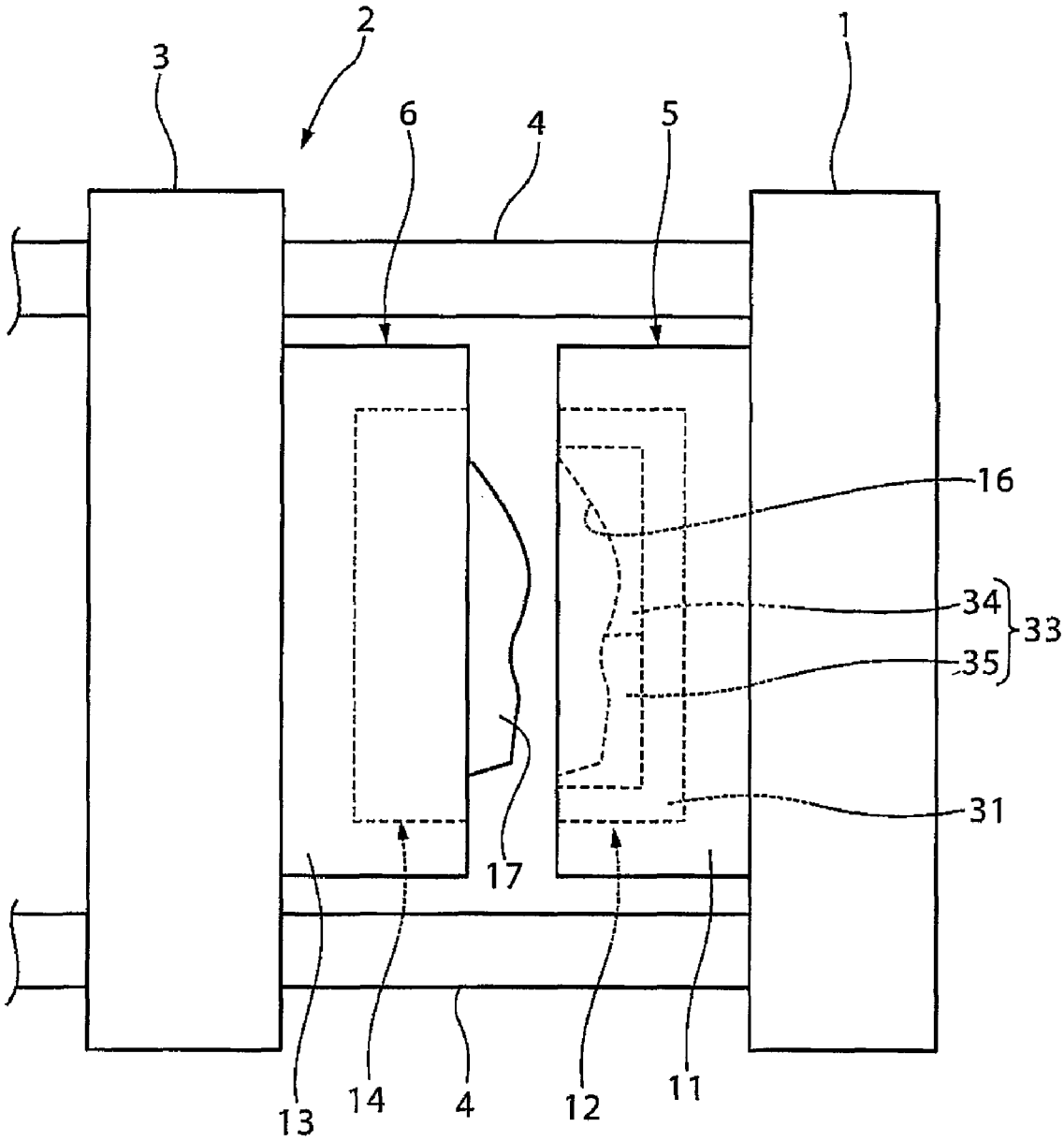
FIG. 1 is a plan view illustrating a die casting mold according to a preferred embodiment of the present invention, which is assembled to a fixed platen and a movable platen of a die casting machine.

Preferred embodiments of a die casting mold according to the present invention and a preferred method of manufacturing the same will be described below in detail with reference to FIG. 1 to FIG. 7.

In the figures, reference numerals 1, 3, and 4 denote a fixed platen, a movable platen, and tie bars of a die casting machine 2, respectively. The fixed platen 1 is fixed to a base (not shown) of the die casting machine 2. The movable platen 3 is designed to move by a drive unit (not shown) on the base in the horizontal direction parallel to the tie bars 4.

A fixed mold 5, or the die casting mold according to the various preferred embodiments of the present invention, is assembled to the fixed platen 1. A movable mold 6, which may be clamped to the fixed mold 5, is assembled to the movable platen 3. In FIG. 1 to FIG. 5, an extrusion pin provided on the movable mold 6, a drive unit for the extrusion pin, cooling water passages provided on both of the molds 5 and 6, a mold clamping mechanism, and so forth are not shown, because these components are common to those which have been widely used. The fixed and movable platens 1 and 3, and the fixed and movable molds 5 and 6 have a similar structure to those used for typical die casting machines, except for the construction of an insert portion to be discussed below.

As shown in FIG. 1, the fixed mold 5 includes a fixed mold body 11 supported by the fixed platen 1 and a fixed insert 12 held within the fixed mold body 11. The fixed mold 5 defines the die casting mold that is described with respect to the various preferred embodiments of the present invention. The fixed insert 12 defines the insert that is described with respect to the various preferred embodiments of the present invention. The movable mold 6 is defined by a movable mold body 13 supported by the movable platen 3 and a movable insert 14 held within the movable mold body 13.

Figure 2:
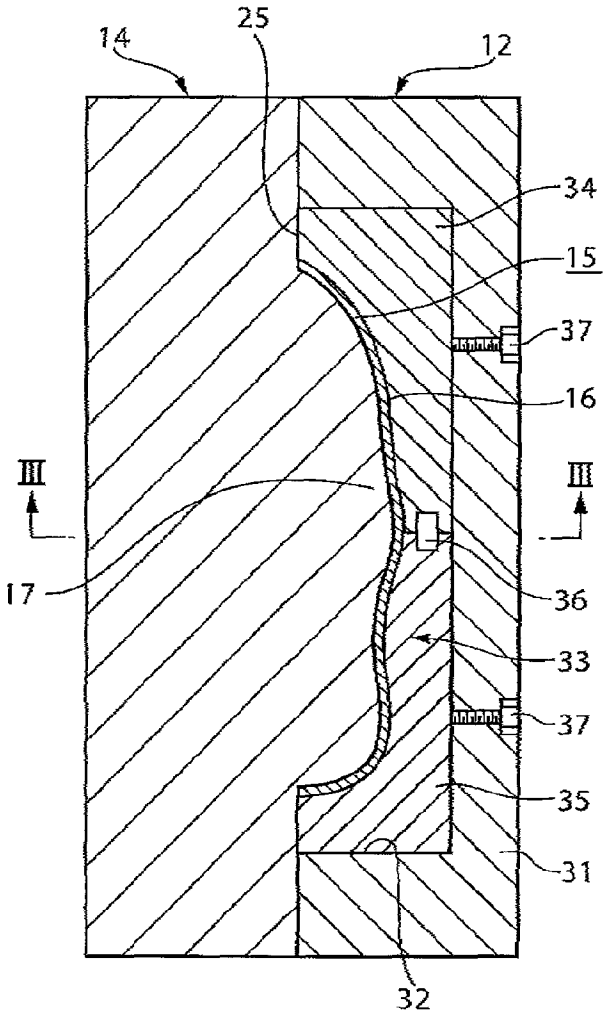
FIG. 2 is a cross-sectional view of a fixed insert and a movable insert.
Figure 3:
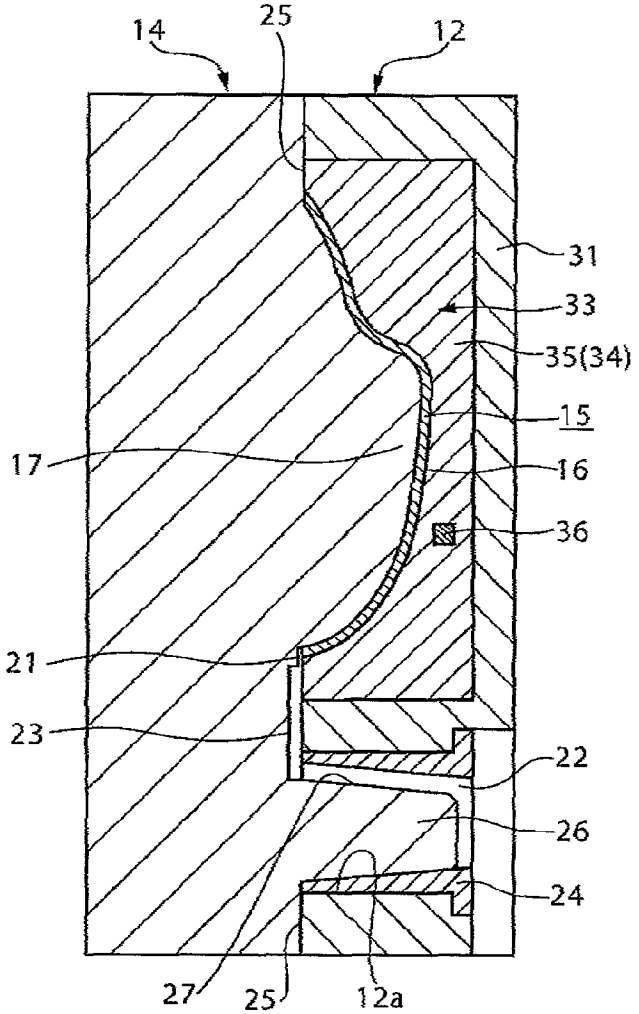
FIG. 3 is a vertical-sectional view of the fixed insert and the movable insert, taken along the line III-III in FIG. 2.

As shown in FIG. 2 and FIG. 3, the fixed insert 12 and the movable insert 14 have a recessed portion 16 and a projecting portion 17, respectively, to define a gap as a cavity 15 between the fixed insert and the movable insert when clamped together. In FIG. 2 and FIG. 3, the cavity 15 is shown by a hatched pattern for the purpose of easily identifying the portion used to cast the product. The molds 5 and 6 according to the present preferred embodiment are preferably designed to cast large parts for motorcycles, for example. The molds 5 and 6 utilize the recessed portion 16 to form an exterior surface of the large parts.

Figure 4:
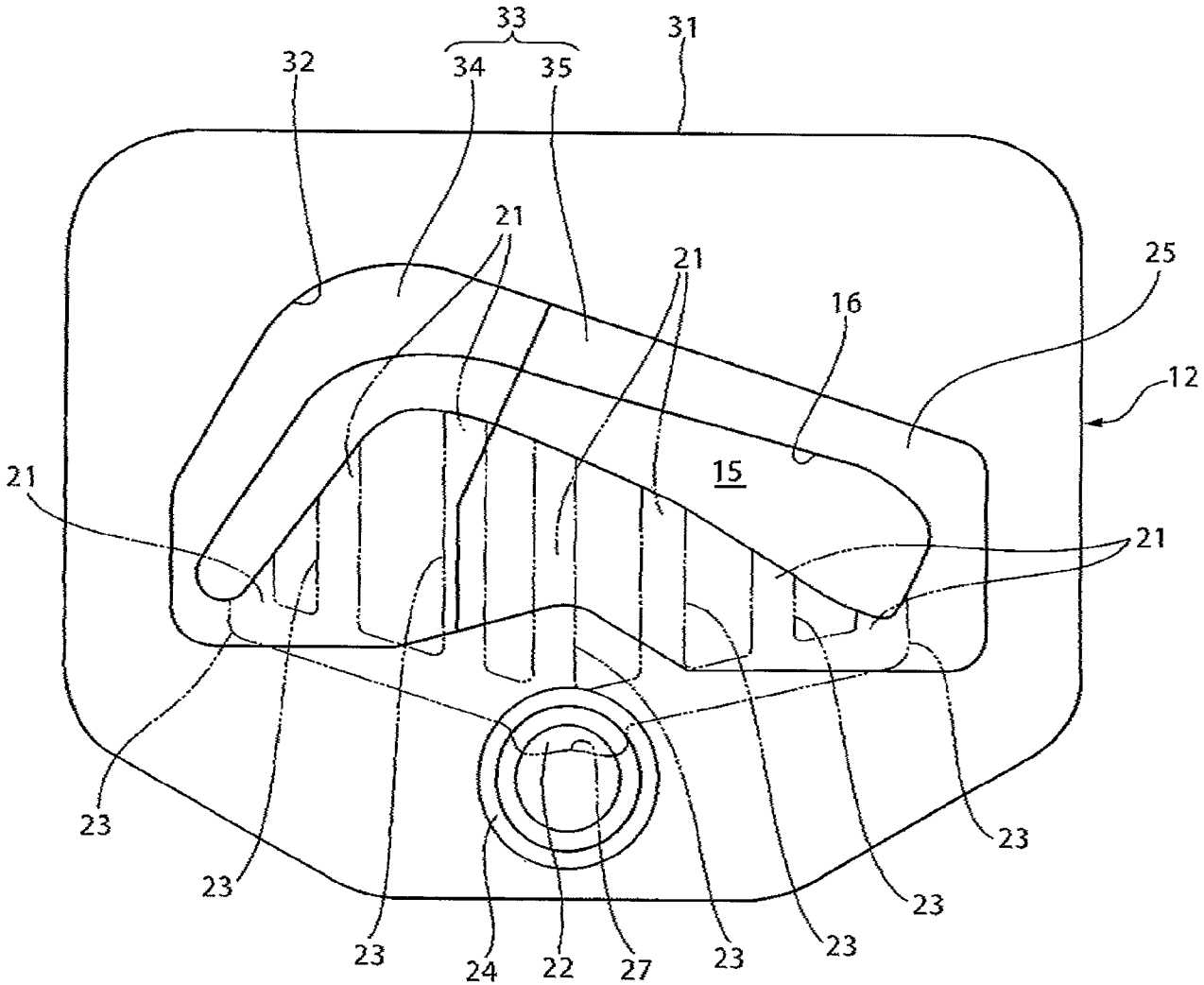
FIG. 4 is a front view of the fixed insert when viewed from the movable insert side.

Molten metal is supplied to the cavity 15 from gates 21 (see FIG. 3) in communication with the bottom end of the cavity. As shown in FIG. 3 and FIG. 4, the molten metal is directed from a sprue 22 preferably provided on the lower end of the fixed insert 12 to the gates 21 through runners 23 recessed in a mating surface of the movable insert 14. The fixed mold 5 and the movable mold 6 according to the present preferred embodiment are preferably designed to cast large parts (not shown) for motorcycles, for example. As shown in FIG. 4, the cavity 15 is arranged such that it extends in the horizontal and vertical directions of the fixed insert 12.

Thus, the runners 23 are arranged to supply molten metal from their respective sections in the horizon direction to the cavity 15 that is elongated in the horizontal direction. In other words, as shown by phantom lines in FIG. 4, the runners 23 are arranged to extend from the sprue 22 to both of the opposite sides and the upper side of the movable insert 14.

As shown in FIG. 3 and FIG. 4, the sprue 22 is preferably arranged between a fixed sleeve 24 fitted into a circular hole 12*a* of the fixed insert 12 and a diverted column 26 of the movable insert 14, which is fitted into the fixed sleeve 24 in a mating surface 25 facing the movable mold 6. Above the diverted column 26, a recessed portion 27 (see FIG. 4) defines a bottom wall of the sprue 22. The fixed sleeve 24 defining the sprue 22 is connected to an injection sleeve (not shown) of the die casting machine 2.

As shown in FIG. 2 and FIG. 4, the fixed insert 12 is preferably defined by a first insert 31 provided with the sprue 22 and held within the fixed mold body 11, and a second insert 33 fitted and held within a recess 32 provided in the first insert 31. Because the movable insert 14 is designed to form a backside of a cast product that is not exposed as an exterior surface and is hardly affected by the presence or absence of heat checks, the movable insert 14 preferably does not use the divided structure of the fixed insert 12.

The size of the second insert 33 having the recessed cavity portion 16 is preferably minimized as much as possible to just surround the cavity 15. The minimized size herein refers to a size that is not sufficient to accommodate the sprue 22 and other mold components, such as cooling water passages (not shown), while being a size having a thickness sufficient to withstand repeated reprocessing, which will be discussed below.

The second insert 33 according to the present preferred embodiment is divided into a left mold member 34 arranged to position a portion of the cavity 15 at one end in the longitudinal direction (horizontal direction in FIG. 4) and a right mold member 35 arranged to position the other portion of the cavity 15 at the other end. In other words, the second insert 33 includes the two mold members 34 and 35 that are combined together to form the single recessed cavity portion 16.

As shown in FIG. 2, the left mold member 34 and the right mold member 35, which are positioned next to each other by a key 36, are fitted together into the recess 32 of the first insert 31. Using the key 36 in a manner to combine the left mold member 34 and the right mold member 35 with each other prevents the mold members 34 and 35 from being deformed due to the casting pressure applied during a casting operation. In other words, the use of the die casting mold according to the present preferred embodiment prevents steps or gaps from being produced on the mating portion between the left mold member 34 and the right mold member 35. This allows a cast product to have a smooth surface.

While being fitted into the recess 32, the mold members 34 and 35 are preferably fastened to the first insert 31 with fastening bolts 37, for example. The second insert 33 according to the present preferred embodiment is preferably made of special steel equivalent to SKD 61 alloy, for example, and is preferably hardened by what is called air blast quenching and tempering. Other than air blast quenching, oil quenching may also be used as the heat processing of the second insert 33, for example.

With reference to the flowcharts of FIG. 6 and FIG. 7, a preferred method of manufacturing the aforementioned second insert 33 will now be described.

Figure 6:
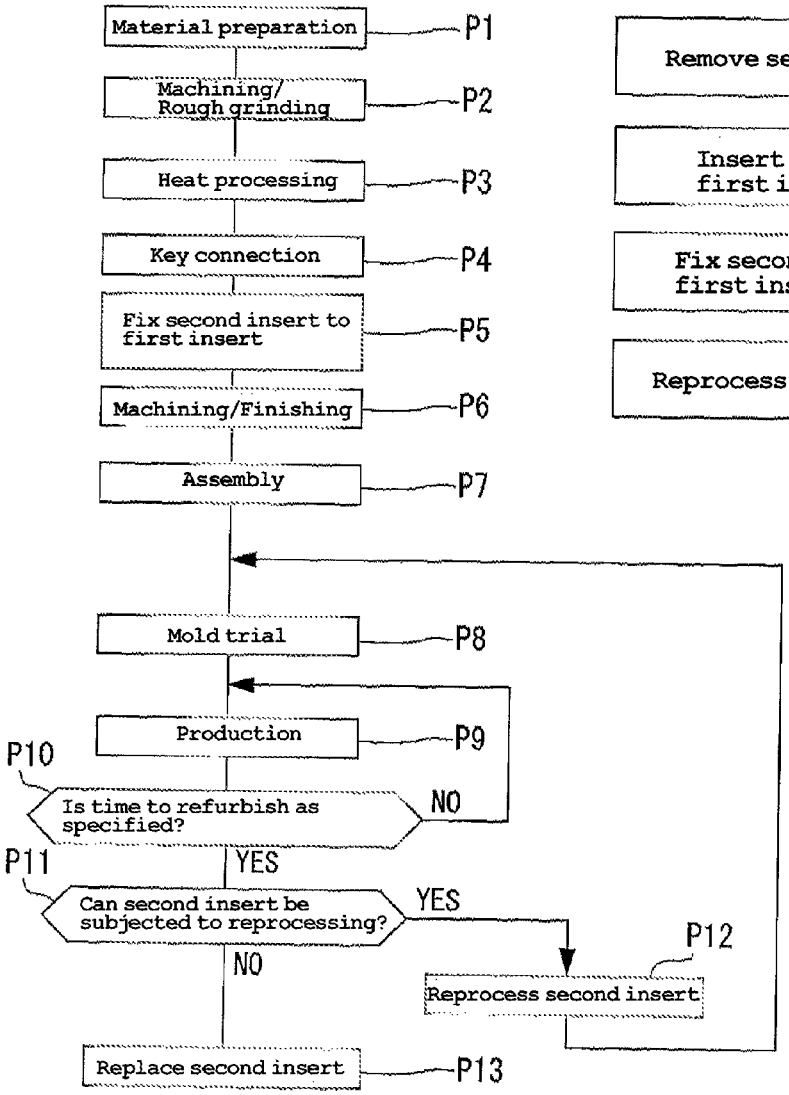
FIG. 6 is a flowchart of the processes of manufacturing and casting the die casting mold according to a preferred embodiment of the present invention.
Figure 7:
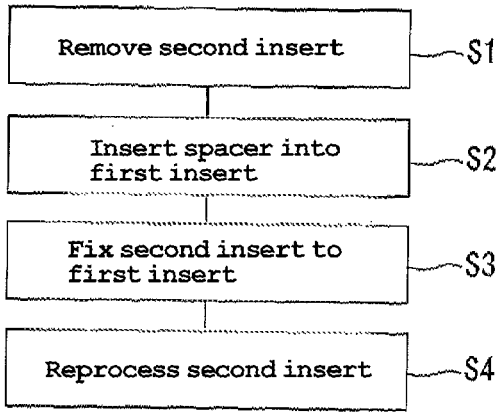
FIG. 7 is a flowchart of the process of reprocessing the second insert.

As the initial process of manufacturing the second insert 33, preferably steel is formed into the left mold member 34 and the right mold member 35 each having a specific exterior shape and dimensions in the steps P1 and P2 shown in the flowchart of FIG. 6. The recessed cavity portion 16 is preferably provided in the mold members 34 and 35 by so-called rough grinding. For example, an NC milling machine may be used for the rough grinding. In addition, the rough grinding is finished in a manner that a certain area for the finishing margin remains on the recessed cavity portion 16. In the step of the rough grinding, the mold members 34 and 35 each have exterior shapes and dimensions such that the mold members are fitted into the recess 32 of the first insert 31.

In the step P3, the left mold member 34 and the right mold member 35 are each subjected to heat processing, which preferably includes air blast quenching and tempering. This allows the entire second insert 33 to be equally and sufficiently subjected to the heat processing.

After the heat processing is completed, the mold members 34 and 35 are preferably combined together with the key 36 (step P4). Then, the combination of the mold members 34 and 35 is fitted into the first insert 31 and preferably fastened thereto with the fastening bolts (step P5). In this step, the second insert 33 may be alternatively fitted and fixed into a jig having a shape consistent with the shape of the first insert 31, and then be transferred to the next step.

As described above, the recessed cavity portion 16 and the mating surface 25, which are provided on the combined left and right mold members 34 and 35, are preferably subjected to finishing processing in the step P6. In the step of finishing processing, electrical discharge machining is preferably performed to reduce the recessed cavity portion 16 by a predetermined dimension. This is followed by grinding preferably using a grindstone and a sandpaper or buffer. With an NC milling machine, the mating surface 25 is reduced by a predetermined dimension, while being cut to the extent that its surface roughness reaches a predetermined level. The finishing processing to the mating surface 25 is preferably performed after the rough grinding during the step P2.

In the step P6, the finishing processing is performed to eliminate any steps created on the connecting portion between the left mold member 34 and the right mold member 35. The finishing processing to the recessed cavity portion 16 may only involve cutting with the NC milling machine, instead of electrical discharge machining, provided the recessed portion 16 has a simple shape. In the case that the NC milling machine is used for the finishing processing of the recessed cavity portion 16, this finishing processing may be performed after the rough grinding during the step P2.

Following the completion of the finishing processing, the first insert 31 including the second insert 33 is attached to the fixed mold body 11, and then the fixed mold body 11 is attached to the fixed platen 1 (step P7). If the finishing processing is performed with the second insert 33 being fitted into the jig, the second insert 33 is initially removed from the jig and attached to the first insert 31, and the first insert 31 is attached to the fixed platen 1 in the same manner as described above. By the time this process is finished, the assembled movable mold 6 will have been attached to the movable platen 3.

A mold trial for checking the manufacturing conditions of the above molds is executed (step P8), and if the results are satisfactory, then production starts (step P9).

After the production starts, a determination is made whether or not the timing to refurbish the molds, which is specified in advance, is right in the step P10. If the result of the determination shows that the timing to refurbish the molds is not right, the process returns to the step P9 to continue production.

The aforementioned "specified timing to refurbish the molds" is preferably obtained empirically from the mold trial (step P8) or the initial process of production. The "specified timing to refurbish the molds" may be based on, for example, the number of casting cycles at which minor heat checks without the need of repair start to occur on a cast product, or the number of casting cycles performed. If either one of the numbers of casting cycles is reached, in other words, if the timing to refurbish the molds is right, a determination is made whether or not the second insert 33 can be subjected to reprocessing that will be discussed later, as shown in the step P11.

In the step P11, a determination is made as to whether or not the second insert 33 has a margin that can be subjected to the reprocessing that will be discussed later. If the determination is made that the second insert 33 has a margin that can be subjected to reprocessing, reprocessing of the second insert 33 is implemented in the step P12.

Figure 5:
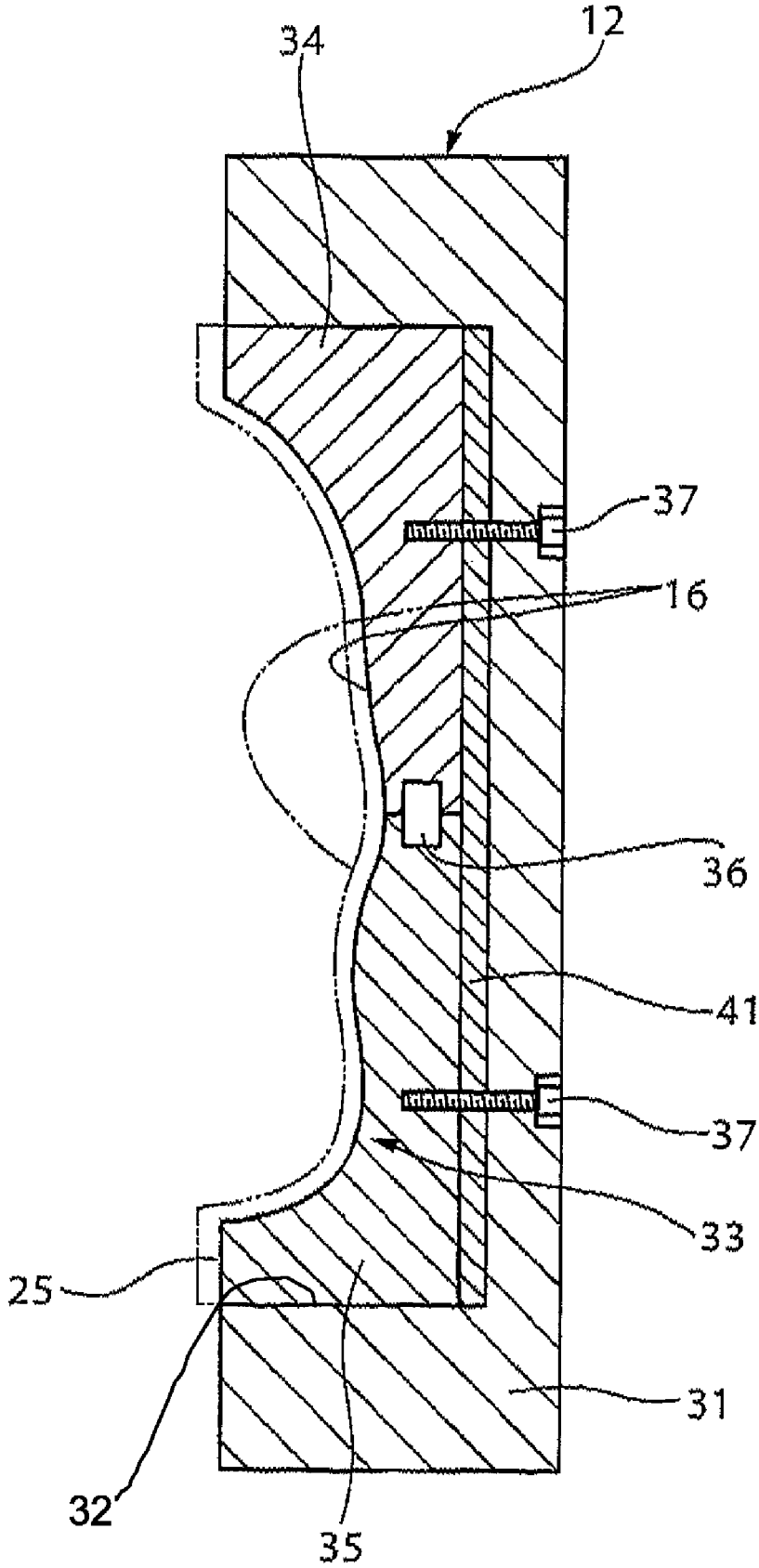
FIG. 5 is a cross-sectional view of the fixed insert with a second insert having been subjected to reprocessing.

Reprocessing of the second insert 33 is implemented with the first insert 31 being removed from the fixed mold body 11. As shown in step S1 of the flowchart in FIG. 7, the second insert 33 is initially removed from the first insert 31. Then, as shown in FIG. 5, a spacer 41 of a given thickness is preferably inserted into the recess 32 of the first insert 31 (step S2). The spacer 41 is preferably formed by stamping a plate material of constant thickness, such as polished steel sheet, into a shape to be fitted into the recess 32.

After the spacer 41 is inserted into the recess 32 of the first insert 31, the second insert 33 is fitted into the recess 32 and preferably fastened with the fastening bolts 37 (step S3). Insertion holes are drilled through the spacer 41 for the fastening bolts 37 to be inserted therethrough. In this step, as shown by the phantom line in FIG. 5, the second insert 33 protrudes by an amount consistent with the thickness of the spacer 41 from the first insert 31.

Next, as shown in step S4, reprocessing of the second insert is implemented. The reprocessing involves removing the protruding portion (mating surface 25) of the second insert 33 and a surface of the recessed cavity portion 16 in the direction of the thickness of the second insert 33 by a dimension consistent with the thickness of the spacer 41. The amount to be removed is increased/decreased depending on the degree of deterioration of the second insert 33 or the number of casting cycles performed.

As the degree of deterioration of the second insert 33 is less significant, or the number of casting cycles performed is relatively smaller, the amount to be removed is relatively reduced. In such a case, the spacer 41 of a relatively smaller thickness is used. The reprocessing in such a case involves removing the recessed cavity portion 16 of the second insert 33 by a dimension consistent with the thickness of the spacer 41 by electrical discharge machining, for example, as well as removing the mating surface 25 by a dimension consistent with the thickness of the spacer 41 using the NC milling machine.

As the degree of deterioration of the second insert 33 is significant, or the number of casting cycles performed is relatively larger, the amount to be removed is relatively increased. In such a case, the spacer 41 of a relatively larger thickness is used. The NC milling machine is preferably used for rough grinding, which is preferably followed by electrical discharge machining for the finishing processing. However, the NC milling machine is preferably used for the mating surface until the end of the finishing processing. In the event where the NC milling machine alone can perform the processing of the entire area of the recessed cavity portion 16, such as where the recessed cavity portion 16 has a simple shape, the reprocessing only involves cutting using the NC milling machine, independent of the amount to be removed.

After the completion of the refurbishing process, or the reprocessing of the second insert 33 in the manner as described above, the first insert 31 is attached to the fixed mold body 11. The process returns to the step P8 of the flowchart in FIG. 6 to repeat the molding trial. If the casting conditions are satisfactory, then the production continues until the timing to refurbish the molds is right, as shown in the steps P9 and P10.

When the timing to refurbish the molds is right, a determination is made whether or not the second insert 33 has a margin that can be subjected to reprocessing in the step P11. If the determination is YES, that is, the second insert 33 has a margin that can be subjected to reprocessing, the process proceeds to the step P12 to implement the aforementioned reprocessing. If the determination is NO, that is, the second insert 22 does not have a sufficient margin that can be subjected to reprocessing, the second insert 33 is replaced with a new one as shown in the step P13. In other words, the casting method preferably includes the casting and refurbishing processes that are repeated multiple times in which, after no additional processing margin remains on the second insert 33, the second insert 33 is replaced with a new one.

As for the die casting mold constructed as described above, when the first insert 31 is the same size as the conventional insert, the second insert 33 provided with the recessed cavity portion 16 is smaller than the conventional insert. Thus, the entire second insert 33 is generally equally and sufficiently subjected to heat processing. The use of the die casting mold according to the present preferred embodiment enhances the hardness over the entire second insert as well as prevents the occurrence of heat checks over a longer period of time.

With the die casting mold according to the present preferred embodiment, in the event that abnormal cast products are manufactured having unrepairable cracks on the recessed cavity portion 16, only the second insert 33 is replaced with a new one, so that the quality of the cast products is maintained from the beginning of the manufacturing process. Thus, according to the present preferred embodiment, only the relatively small second insert 33 needs be replaced, so that mold repair costs can be reduced compared to the conventional art in which a large insert must be replaced. Moreover, the second insert 33 is small and easily fabricated, and accordingly the time required for the aforementioned repairing (the time required for re-fabricating the second insert 33) is also reduced.

The die casting mold according to the present preferred embodiment has the second insert 33 which is preferably divided into two portions. Thus, with the second insert 33 of the mold being divided into two portions for heat processing, the entire second insert 33 can be equally and sufficiently subjected to heat processing, even when the overall size of the second insert 33 may be relatively large. In the event that the size of the recessed cavity portion 16 is relatively small enough to be sufficiently subjected to heat processing, the second insert 33 may not be divided, or even when the size of the recessed cavity portion 16 is relatively larger, the second insert may be divided into three, four, or more appropriate portions. As previously noted, the second insert 33 is preferably divided into plural small portions of the mold members, which allows each portion of the mold members to be subjected to heat processing more equally and sufficiently.

Therefore, according to the present preferred embodiment, a die casting mold is provided which can reduce the chance of heat checks from occurring while manufacturing relatively large cast products.

The die casting mold according to the present preferred embodiment has the recessed cavity portion 16 provided on the second insert 33, with the second insert 33 being designed to be attached to/detached from the first insert 31, so that the spacer 41 may be interposed between the first insert 31 and the second insert 33. Thus, as for the die casting mold according to the present preferred embodiment, cutting or electrical discharge machining may be used to remove the surface of the recessed cavity portion 16, when, for instance, the number of casting cycles performed exceeds a predetermined number. In such a case, it is only the second insert 33 that needs be subjected to the removal processing.

Therefore, by using the die casting mold according to the present preferred embodiment, the area to be repaired is reduced, compared to the conventional art using a die casting mold that involves removal processing over the entire fixed insert (equivalent to both the first insert 31 and the second insert 33 described in the present preferred embodiment) held within the fixed mold body. This facilitates repair. Consequently, using the die casting mold according to the present preferred embodiment can reduce costs required for repairing the molds.

The sprue 22 is preferably formed on the first insert 31 to be used in the die casting mold according to the present preferred embodiment. Thus, the size of the second insert 33 is reduced compared to the case that the sprue 33 is provided on the second insert 33. According to the present preferred embodiment, the smaller size of the second insert 33 allows more effective heat processing of the second insert 33. In addition, the present preferred embodiment not only further reduces the cost for repairing the deteriorated insert, but also further reduces the time required for the repair.

A method of manufacturing the die casting mold according to a preferred embodiment of the present invention includes interposing the spacer 41 between the first insert 31 and the second insert 33 upon, or prior to, occurrence of minor heat checks without need of repair on a cast product; and removing the recessed cavity portion 16 of the second insert 33 and the mating surface 25 provided around the recessed cavity portion 16 that mates with the movable mold 6 by a dimension consistent with the thickness of the spacer 41. This allows the recessed cavity portion 16 to be restored to its initial conditions.

Thus, unlike the conventional method that involves removal of the surface of the recessed cavity portion 16 having deep cracks, no heat checks occur because of the method of manufacturing the die casting mold according to the present preferred embodiment, although heat checks could occur after a further number of casting cycles have been performed than the conventional method. Consequently, the manufacturing method according to the present preferred embodiment can eliminate the occurrence of heat checks that need repair, while enhancing the endurance and increasing the number of casting cycles to be performed.

A casting method using the die casting mold according to a preferred embodiment of the present invention includes the steps of casting a number of casting cycles at which minor heat checks without the need of repair start to occur on a cast product, or a number less than that number; and refurbishing the die casting mold by interposing the spacer 41 between the first insert 31 and the second insert 33 after the number of casting cycles is reached, and removing the recessed cavity portion 16 of the second insert 33 and the mating surface 25 formed around the recessed cavity portion 16 that mates with the movable mold 6 by a dimension consistent with the thickness of the spacer 41. The casting and refurbishing steps may be repeated multiple times. When there is no additional margin for processing, the second insert 33 is replaced with a new one. Thus, according to the present preferred embodiment, because the second insert 33 can be refurbished repeatedly many times, the number of casting cycles to be performed may be increased without replacing with a new insert, unlike the case of the conventional manufacturing method.

In the casting method according to the present preferred embodiment, in the refurbishing step, while the left mold member 34 and the right mold member 35 are combined together, the recessed cavity portion 16 provided on the mold members 34 and 35 and the mating surface 25 formed around the recessed cavity portion 16 that mates with the movable mold 6 are removed by a dimension consistent with the thickness of the spacer 41. Therefore, the plurality of mold members 34 and 35 are equally subjected to the removal processing. This ensures high-precision manufacturing of cast products, even though the second insert 33 is made up of the plural mold members 34 and 35.

The preferred embodiments of the present invention are preferably applicable to a die casting mold mounted to a die casting machine for casting vehicle parts and building structures. The preferred embodiments of the present invention are also applicable to a method of manufacturing the above type of die casting molds, and is further applicable to a molding method using the above type of die casting molds.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A die casting assembly including a platen and a die casting mold attached to the platen, the die casting mold comprising:

an insert having a recessed cavity portion; and a mold body arranged to hold the insert; wherein the insert includes a first insert held within the mold body, and a second insert held within a recess in the first insert; and the second insert surrounds the recessed cavity portion.

2. The die casting mold according to claim 1, wherein the second insert is sized so as not to accommodate other mold components of the die casting mold.

3. The die casting mold according to claim 1, wherein the second insert includes a plurality of mold members combined together to define the recessed cavity portion.

4. The die casting mold according to claim 3, further comprising at least one key arranged to position the plurality of mold members with respect to each other.

5. The die casting mold according to claim 1, further comprising a spacer interposed between an inner bottom portion of the recess of the first insert and the second insert.

6. The die casting mold according to claim 1, wherein the first insert is provided with a sprue, and the second insert is not provided with a sprue.

7. A method of manufacturing a die casting mold assembly, the die casting mold assembly including a platen and a die casting mold attached to the platen, the die casting mold including an insert defined by a first insert held by a molding body and a second insert held within a recess in the first insert, the second insert surrounding a recessed cavity portion, the manufacturing method including the steps of:

interposing a spacer between an inner bottom portion of the recess of the first insert and the second insert;

removing a portion of the recessed cavity portion of the second insert and a surface arranged around the recessed cavity portion by a dimension consistent with the thickness of the spacer.

8. A casting method using a die casting mold assembly, the die casting mold assembly including a platen and a die casting mold attached to the platen, the die casting mold including an insert having a first insert held by a molding body, and a second insert surrounding a recessed cavity portion, the second insert held within a recess provided on the first insert, the casting method including the steps of:

casting a number of casting cycles using the die casting mold;

refurbishing the die casting mold by including interposing a spacer between the first insert and the second insert after a predetermined number of casting cycles, and removing a portion of the recessed cavity portion of the second insert and a mating surface provided around the recessed cavity portion by a dimension consistent with a thickness of the spacer; and repeating the casting and refurbishing steps multiple times until the portion of the recessed cavity portion and the mating surface is greater than a predetermined margin, then replacing the second insert with a new second insert.

9. The casting method according to claim 8, wherein the second insert includes a plurality of mold members combined together to define the recessed cavity portion, and in the refurbishing step, while the plurality of mold members are combined together, the recessed cavity portion and the mating surface are removed by the dimension consistent with the thickness of the spacer.

10. The casting method according to claim 9, further comprising simultaneously heat processing the plurality of mold members.

11. The casting method according to claim 9, further comprising positioning the plurality of mold members with respect to each other with a key.

12. The casting method according to claim 8, wherein the removing step includes cutting with an NC milling machine or electrical discharge machining.

13. The casting method according to claim 8, further comprising providing the first insert with a sprue, and not providing the second insert with a sprue.

* * * * *